US005800053A

United States Patent [19]

Shen

[11] Patent Number: 5,800,053

[45] Date of Patent: Sep. 1, 1998

[54] ELEVATION ADJUSTMENT STRUCTURE FOR UPRIGHT LAMP ARM

[76] Inventor: Jonny Shen, 3F-1, No. 1, Yung An South Rd., Lu Chou Hsiang, Taipei Hsien, Taiwan

[21] Appl. No.: 799,417

[22] Filed: Feb. 12, 1997

[51] Int. Cl.[6] ..... F21S 1/12

[52] U.S. Cl. ..... 362/413; 362/285; 362/418

[58] Field of Search ..... 362/285, 288, 362/413, 414, 418, 419, 431

[56] References Cited

U.S. PATENT DOCUMENTS

| | | | |
|---|---|---|---|
| 1,919,114 | 7/1933 | Ley | 362/413 X |
| 4,874,991 | 10/1989 | Ruskin | 315/362 |
| 5,155,667 | 10/1992 | Ho | 362/190 |

*Primary Examiner*—Stephen F. Husar
*Attorney, Agent, or Firm*—Birch, Stewart, Kolasch & Birch, LLP

[57] ABSTRACT

The present invention relates to an elevation adjustment structure for household upright lamp arm, and the structure has a cage ring with high-resilience fence ring body, and the cage ring has an open ring with axial notch, and the ring body is mounted near the end of inner rod of lamp arm, and the end of ring body with setting pieces is mounted on the end of inner rod; an end plug is screwed in the end of inner rod with cage ring by means of its thread plug; power cord is inserted through the outlet port near the base of outer rod of lamp arm and extending into the inner rod by means of axial hole of end plug, and an open end of inner rod is connected to the lamp; a screw is rotated into the thread hole on the flange of end plug for retaining the power cord in position; the end of inner rod with end plug is mounted in the outer rod and the distal end of outer rod is screwed with a screw cover; with such assembly the resilience of cage ring may enable the inner rod to move up and down for random positioning to achieve the purpose of easy adjustment of lamp arm elevation.

1 Claim, 2 Drawing Sheets

ELEVATION ADJUSTMENT STRUCTURE FOR UPRIGHT LAMP ARM

BACKGROUND OF THE INVENTION

The present invention relates to an elevation adjustment structure for upright lamp arm, which is to use a cage ring mounted between the inner and outer rods of lamp arm for securing the inner rod.

Lamps are a very common device in our daily life, such as roadside lamp, factory lighting and household lighting device; owing to different locations and purposes, lamps have various kinds of shapes, colors and fixings; in general it is impossible for indicating every problem of lamps and the present invention is focused on the elevation adjustment structure for upright lamp arm.

To meet the need of each purpose for use, lamps are designed into fixed, movable or semi-movable types; semi-movable type relates to the type of lamps fixedly installed at specific place but their elevation or angle is adjustable; for most of lamps with the requirement of elevation or angle adjustment have carried out these functions by means of the arm connected to the lamp and the shape of these adjustable arms is unlike the fixed type arm and likely spring ring just like the extension coil of telephone set, or crank rod or extensible inner/outer rods.

Referring to those elevation adjustment devices by means of extension of inner and outer rods, they may be hydraulic or mechanical adjustment subject to elevation adjustment precision as required for the products; as household lamps are not necessary for making elevation adjustment up to precision tolerance and in consideration of production cost they do not adopt hydraulic and complicated design at high cost but adopt simple and mechanical adjustment device.

For the simple and mechanical adjustment structures, the most common and successful one may be the screw type. Referring to FIGS. 1 and 2, the two elevation adjustment structure are the typical elevation adjustment by means of screw wherein the structure in FIG. 1 has used the screw knob 11 mounted on the outer rod 10 of the lamp arm to allow the front end of the knob for stretching into the outer rod 10 and holding the external surface of the inner rod 12 so that the inner rod 12 may extend or shrink to any point within the outer rod 10; the advantages of said structures may make the inner rod extensibly positioning at the internal part of the outer rod by means of a simple screw knob to meet the purpose of arm elevation adjustment; however, they have a shortcoming that screw knob one-point retaining inner rod may not be strong enough to support the lamp to result in lamp arm sliding; such screw knob, after screwing up and releasing for a long period, is easy to cause the thread wearing on the outer rod thread hole or screw knob and this will affect the screw knob for retaining the inner rod to result in inner rod sliding; on the other hand, such design should be operated by both hands, i.e, adjust the knob with one hand and adjust the elevation of the inner rod with the other hand, and such a way of operation is a serious problem for those hand disabilities.

Another structure of screw adjusting lamp arm elevation as shown in FIG. 2. the top end of outer rod has a ring-thread groove 13 which has an up-reducing cone; the nut 14 is made into down-expanding internal thread 140 for screwing up with the ring thread groove 13; when the nut 14 is screwed up far away from the outer rod 10 end, the thread groove 13 will expand externally to reduce external binding force of the inner rod 12 to allow for free elevation adjustment in the outer rod; on the contrary, when the nut 14 is screwed down near the outer rod end, the thread groove will shrink up forcibly to retain the inner rod to cause difficult elevation adjustment of the inner rod in the outer rod and thus to keep at a fixed elevation position. The screw elevation adjustment has the same advantage and shortcoming as said screw knob.

The conventional screw adjustment of lamp arm elevation is easy to result in sliding due to the lamp arm not strong enough to support the weight of the lamp, and such a way of operation may cause some inconvenience to certain people; another shortcoming of the conventional screw elevation adjustment is that if the screw knob or nut is tightened, the outer rod can not be rotated so turning the lamp should rely on another steering mechanism to increase structural complexity of lamp arm as well as production cost; in view of following shortcomings found in the conventional screw adjustment structures, the present invention has tried not to use screw adjustment structure while to use a cage ring which is mounted on the distal end of the inner rod and then placed in the inner hole of the outer rod; with the help of cage ring internally retaining the outside diameter of the inner rod and externally holding the inside diameter of the outer rod, the inner rod may be movable in position within the outer rod and movement adjustment can be made with one hand only; as the cage ring externally thrusts with its ring so its thrust point may increase support capacity for the gravity of the lamp to keep it from sliding; as the cage ring may be engaged in circumference movement after thrusting the inside diameter of the outer rod so it gives positive help to the rotation of the lamp after the setup of lamp arm elevation.

These and other objects and advantages of the present invention will become apparent to those skilled in art after considering the following detailed specification together with the accompanying drawings.

DETAILED DESCRIPTION OF PREFERRED EMBODIMENTS

Figure 3:
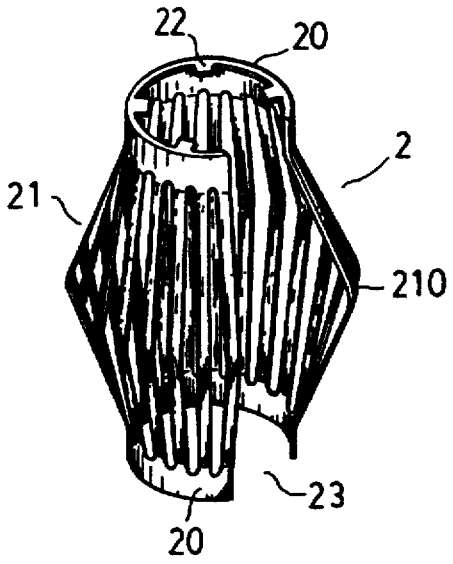
FIG. 3 is a profile of case ring of the present invention.
Figure 4:
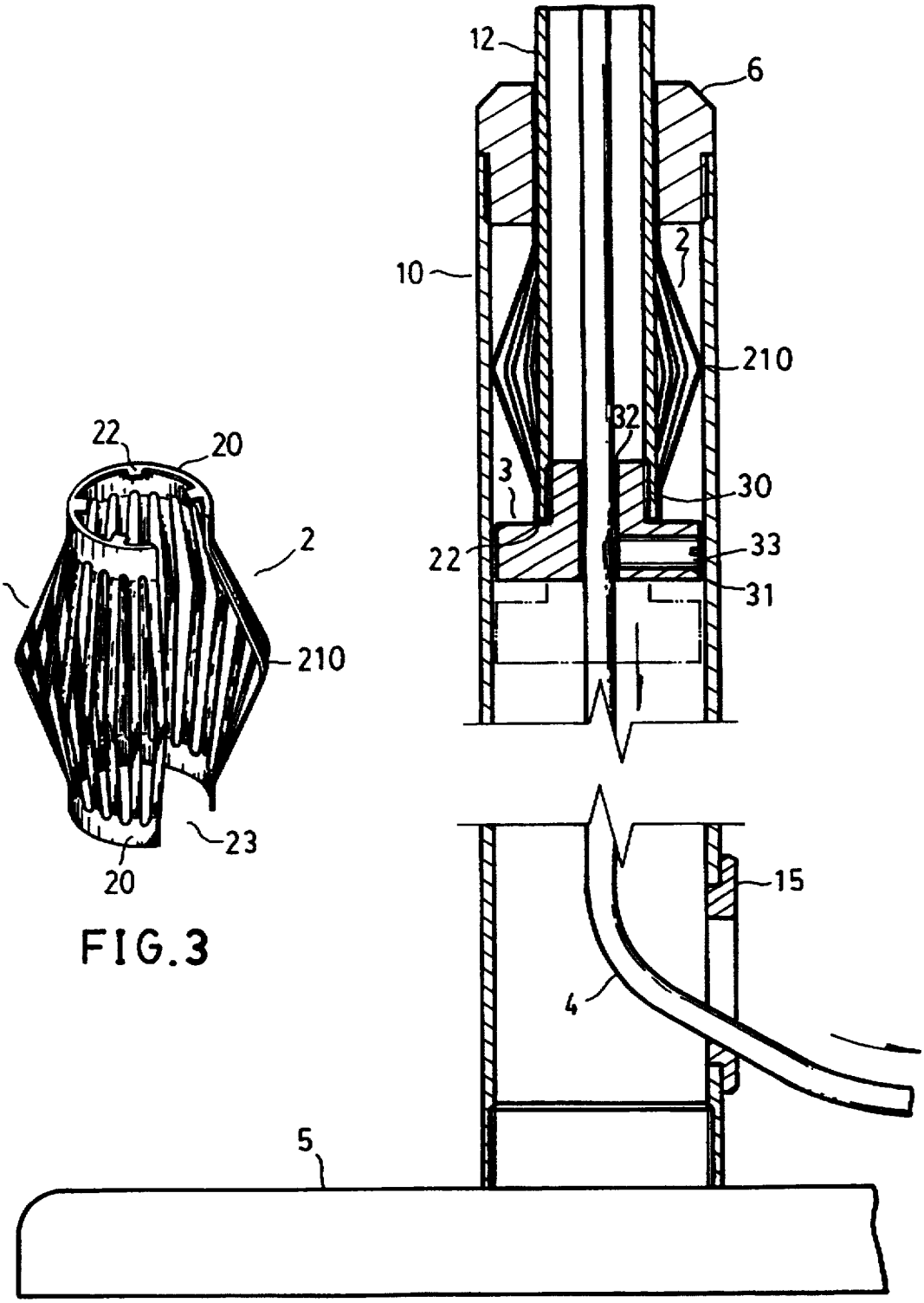
FIG. 4 is a structural assembly view of the present invention.

Referring to FIG. 3, the present invention has reached the purpose of lamp arm elevation adjustment by means of a cage ring mounted between the inner and outer rods; said cage ring 2 is made from the material of high tension and resilience, and its both ends resemble a small plate ring portion 20, and the ring portion between the two plate ring portions resembles a fence ring 21 with intermediate section 210 expanding and reducing toward the plate ring portions 20; the inner ring side at the end of said cage ring 2 is projected with a plurality of setting pieces 22 distributed at equal distance, and said cage ring 2 is not a closed ring but an open ring body with an axial notch 23.

Said cage ring 2 is mounted near the end of the inner rod 12 of lamp arm and said setting pieces 22 retain the distal end of the inner rod 12; another end plug 3 is screwed into the end of the inner rod 12 mounted with cage ring 2 by means of a thread plus 30, and said end plug 3 has a thread hole 31 exposed to the flange of the inner rod 12, and the center of said end plug 3 has an axial hole 32. Upon completion of the installation of the cage ring and end plug 3 in the inner rod 12, the power cord 4 of lamp is inserted from the axial hole 32 of end plug 3, extending through the inner rod 12 to the lamp wire (not shown); upon completion of wiring, the power cord is screwed into the thread hole 31 by means of a screw 33, and a section of the power cord is fixed in the end plug 3. Referring to said assembly, the end of inner rod 12 with the end plug 3 is inserted in the outer rod 10, and the power cord 4 is extending to the socket (not shown) from the outer rod 10 through the outlet port 15 near the top of the base 5, and the upper end of the outer rod 10 is sealed with a screw cover 6 after the power cord 4 inserted to prevent the inner rod from separated with the outer rod.

Figure 5:
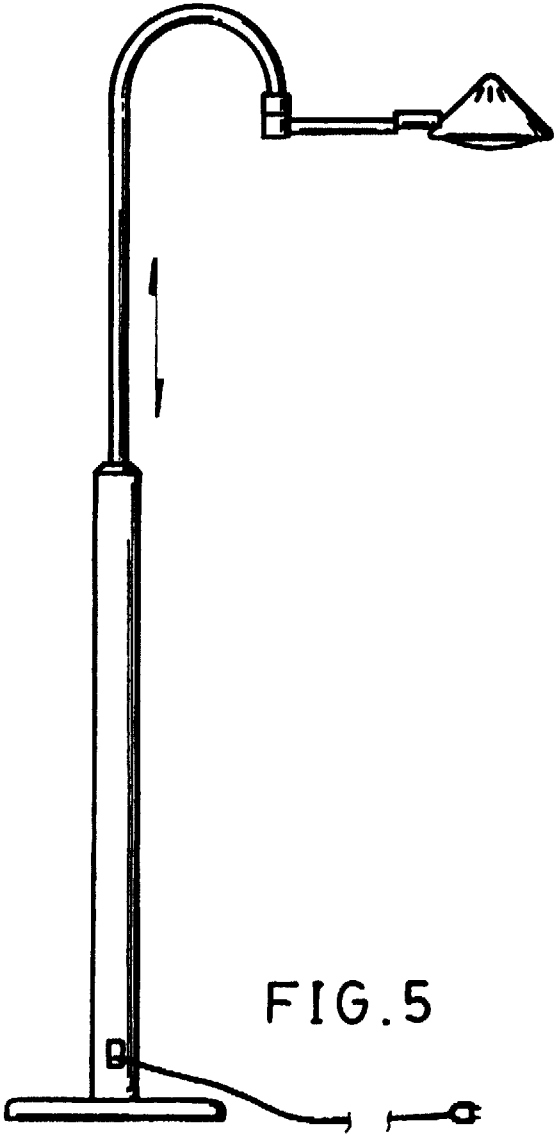
FIG. 5 is an embodiment of the present invention.
Figure 2:
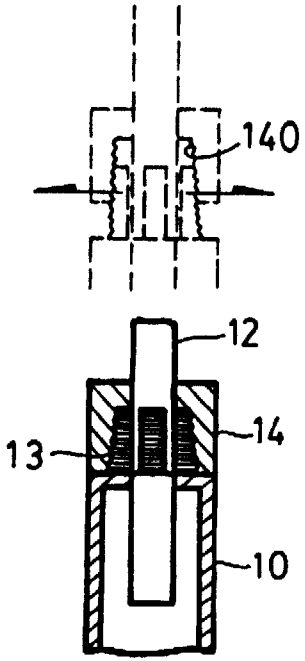
FIG. 2 (PRIOR ART)
FIGS. 1 and 2 show the conventional elevation adjustment structure of lamp arm.
Figure 1:
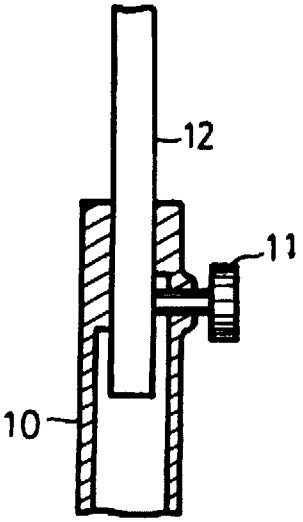
FIG. 1 (PRIOR ART)

According to said structural assembly, the elevation control of lamp arm is achieved by holding the external part of the inner rod 12 exposed to the outer rod 12, and then pulling up or pushing down the inner rod from the outer rod (see FIG. 5); at the moment the cage ring 2 within the outer rod 12 is moving up and down in accordance with the inner rod 10, and the power cord 4 will be pulled to move up or down. The present invention may achieve the purpose of arm elevation adjustment by means of pulling/pushing the inner rod with one hand, and further it may enable the lamp arm to stand firm at fixed elevation after elevation adjustment, and the key point to the control lies in the design of cage ring. The notch 23 formed on the ring body of the cage ring 2 is mainly for reducing counter-pressure of ring body against the internal wall of the outer rod 12 although said counter-pressure may prevent sliding due to lamp weight to keep the inner rod standing firm at certain elevation on the internal wall of the outer rod 12, however excessive counter pressure will have negative impacts as such: adjusting lamp arm elevation should apply more force to offset the counter pressure to make possible for pulling the inner rod and this will cause adjustment difficulty; therefore the notch 23 according to the present invention must be cut at the right place to support the gravity of lamp and to facilitate elevation adjustment of lamp arm. The purpose for the intermediate ring body of cage ring 2 designed into a fence ring 21 is to form an expansion and flexible structure, which is not only able to retain the internal wall of the outer rod but also able to make lamp arm standing firm and easy for moving lamp arm to another position of elevation during adjustment. The design of outward expansion for the intermediate section 210 of fence ring 21 of cage ring 2 is mainly for providing adequate outward counter pressure while having the least frictional resistance so a very small contact area is formed between the intermediate section 210 and the internal wall of outer rod 12, and the design may allow for using smaller strength to pull up or push down the lamp arm during elevation adjustment; the design may also make easy for lamp arm to turn for adjusting the angle of lighting after elevation adjustment so it is not necessary for increasing a lamp steering adjustment device. Setting pieces 22 at the end of the cage ring 2 enables the cage ring 2 to exert the best retaining ability after mounted on the inner rod 12 for it will not occur any movement during elevation adjustment. Another major point to the design of the present invention lies in the power cord 4 is screwed in the axial hole 31 of end plug 3 by means of a screw 32, and it enables the power cord 4 for moving up and down in accordance with the inner rod 12 during the lamp arm elevation adjustment, to avoid the power cord 4 short-circuit due to twisting.

As the present invention has used the cage ring to achieve the purpose of random elevation adjustment for the lamp arm and easy steering after elevation adjustment so any ring body which is made based on such characteristic shall belong to the scope of the claims.

What is claimed is:

1. An elevation adjustment structure for lamp arm, including a cage ring and end plug wherein:

said cage ring made from high resilient material; both ends of it having a small plate ring respectively and a fence ring formed between the two plate rings, said fence ring to form a cage ring by means of two plate rings expanding toward the intermediate section; the end of said cage ring projected with a plurality of setting pieces distributed at equal distance on the inner ring; said cage ring resembling an open ring body with axial notch;

end plug having connection flange, said flange having a thread hole and the center of end plug having an axial hole;

said cage ring and other parts mounted near the end of the inner rod of lamp arm and retained by setting pieces of cage ring; said end plug screwed in the inner rod by means of thread plug; the power cord inserted from the outlet port near the base of outer rod and then inserted in the axial hole of end plug and extending to the lamp connection through the other end of inner rod and screwed in the thread hole of end plug by means of a screw for fixing a length of power cord; the inner rod of lamp arm mounted in the outer rod with the end having end plug, and the distal end of outer rod sealed with a screw cover for holding the cage ring and end plug to prevent the inner rod from separated with the outer rod.

* * * * *